United States Patent [19]

Pugliese

[11] 4,019,482

[45] Apr. 26, 1977

[54] FUEL SEPARATOR

[76] Inventor: Rocco J. Pugliese, 501 Emmons, Lincoln Park, Mich. 48146

[22] Filed: Feb. 5, 1976

[21] Appl. No.: 655,520

[52] U.S. Cl. ..... 123/141; 48/180 R; 261/DIG. 19; 261/DIG. 55

[51] Int. Cl.[2] ..... F02B 25/06

[58] Field of Search ..... 123/141; 48/180 R; 261/DIG. 19, DIG. 55

[56] References Cited

UNITED STATES PATENTS

| | | | |
|---|---|---|---|
| 1,790,854 | 2/1931 | Defrance et al. | 123/141 |
| 2,977,205 | 3/1961 | Austin | 123/141 |
| 3,826,235 | 7/1974 | Pasbmg | 123/141 |
| 3,831,568 | 8/1974 | Heimburg | 123/141 X |
| 3,847,125 | 11/1974 | Malherbe | 261/DIG. 55 |
| 3,966,430 | 6/1976 | Stephens | 48/180 R |

*Primary Examiner*—C. J. Husar
*Assistant Examiner*—Ira S. Lazarus
*Attorney, Agent, or Firm*—Basile, Weintraub and Vanophem

[57] ABSTRACT

A fuel separating device adapted to be connected between a carburetor and the intake manifold or integrally built into the intake manifold of an internal-combustion engine for removing excess fuel from the fuel-air mixture provided by the carburetor. The device comprises a housing having upper and lower chambers that are separated by a plate having a plurality of upright tubular members which communicate the upper chamber to the lower chamber. The device has an inlet port communicating the upper chamber to the outlet of the carburetor and an outlet port which communicates the lower chamber to the inlet of the manifold such that a fuel flow passage is provided for directing the fuel-air mixture from the carburetor to the manifold, while excess fuel droplets carried by the mixture are deposited at the bottom of the upper chamber. Means are provided for drawing off the excess fuel and returning it to the fuel supply tank.

7 Claims, 3 Drawing Figures

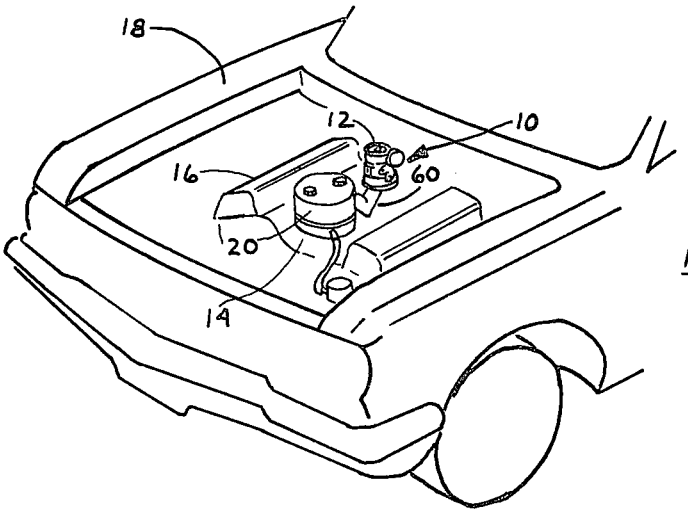
FIG-1
FIG-2
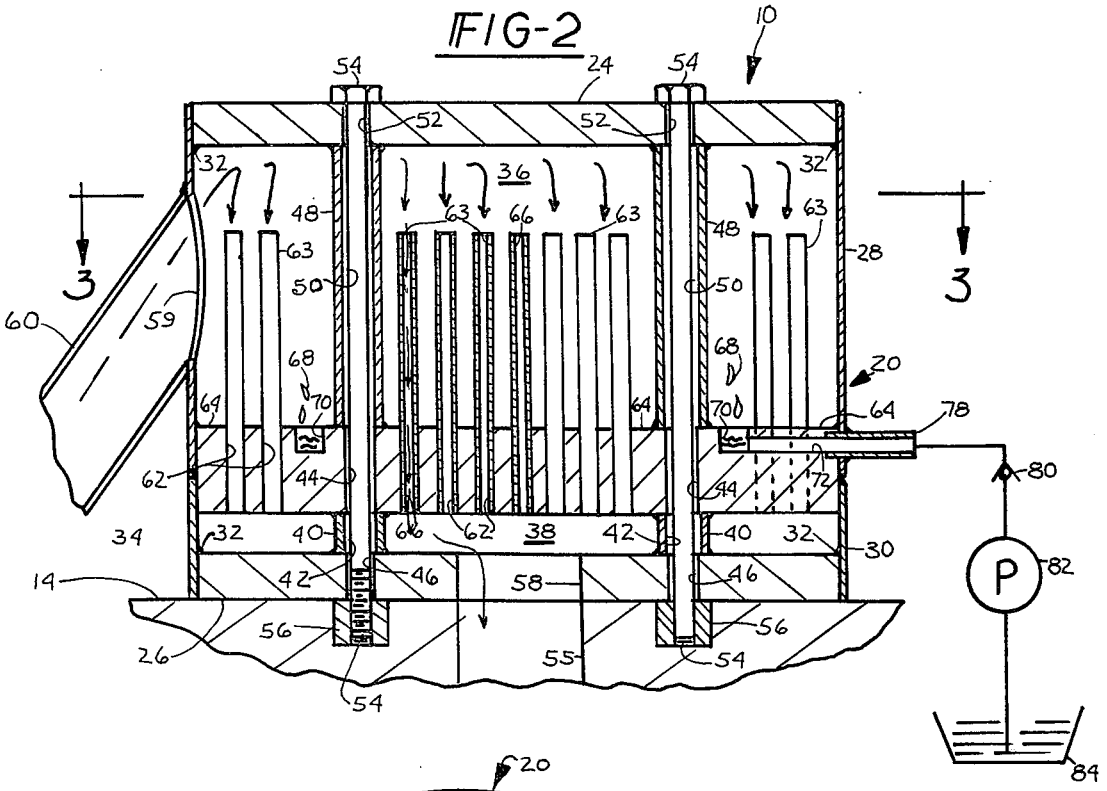
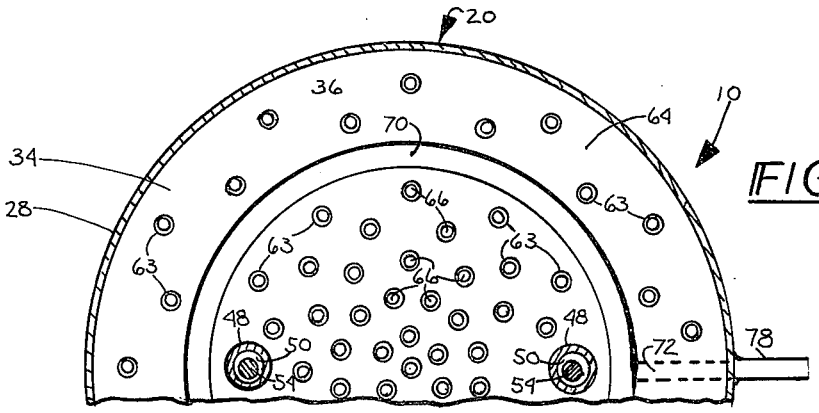
FIG-3

FUEL SEPARATOR

BACKGROUND OF THE INVENTION

I. Field of the Invention

The present invention relates to fuel-air mixing systems for internal-combustion engines and, more particularly, to a fuel-air mixing system which automatically removes excess fuel droplets from the fuel-air mixture provided by the carburetor.

II. Description of the Prior Art

It is well known that satisfactory, idle, or minimum power operation of an internal-combustion engine ordinarily requires admitting an inlet charge which is relatively rich. There are several factors leading to this requirement of the rich fuel-air mixture, but the fundamental factor is that a predetermined flame temperature must be maintained in a combustion chamber to support the combustion of the fuel-air mixture. Since this flame temperature is an average of the burned and unburned charge portion temperatures, the predetermined temperature is ordinarily maintained by elevating the burned charge temperature at low-power operation by means of the admission of the rich fuel-air mixture. It is also known that the admisstion of such rich mixtures under low power and part throttle operation of the engine tends to promote an exhaust which is high in unburned hydrocarbon content.

To alleviate this condition, numerous systems have been proposed in the prior art. Many of the systems employ various types of fuel-mixture preheaters which function to vaporize the fuel in the mixture before the mixture enters the intake manifold of the engine for the purpose of improving the efficiency of the engine. In a gasoline engine the preheater is customarily connected between the outlet of the carburetor and the inlet of the intake manifold and is in the form of a heat exchanger which utilizes either the hot exhaust gases of the engine or the hot water in the engines's coolant sytem as a source to heat the vaporized fuel. In some heat exchangers, baffles are arranged in the path of the stream of the fuel-air mixture for the purpose of retarding the flow of the fuel droplets within the heating chamber until sufficient vaporization has taken place. One example of such a fuel droplet-retarding baffling arrangement is described in U.S. Pat. No. 2,232,413; and a second example is disclosed in U.S. Pat. No. 3,645,243. Other examples of attempts which have been made to increase the efficiency of internal-combustion engines are disclosed in U.S. Pat. Nos. 2,617,633; No. 3,554,174; and No. 3,797,468.

Each of the aforementioned systems generally are inordinately complex in a mechanical sense and have not yet demonstrated any significant commercial practicality.

SUMMARY OF THE INVENTION

The present invention, which will be described subsequently in greater detail, comprises a fuel separating device adapted to be connected between a carburetor and an intake manifold of an internal-combustion engine for removing excess fuel from the fuel-air mixture which is communicated from the carburetor to the manifold with the excess fuel being returned to the fuel supply tank.

The invention is preferably carried out with a device that comprises a housing having upper and lower chambers separated by a plate which, in turn, carries a plurality of upright tubular members that extend through the plate to the upper regions of the upper chamber so as to provide a flow passage from the upper chamber to the lower chamber of the device. The housing has an inlet port communicating the upper chamber to the outlet of the carburetor, while an outlet port is provided at the bottom of the housing for communicating the lower chamber to the inlet of a manifold such that a flow passage is provided for directing the mixture from the carburetor to the manifold, the device being so devised that excess fuel droplets carried by the air-fuel mixture are captured in the upper chamber and collected at the bottom thereof to be drawn off through a separate conduit and returned to the fuel supply tank.

It is therefore an object of the present invention to provide a novel fuel separating device wherein a high degree of vaporization of the fuel is maintained and wherein the vaporized fuel-air mixture passing from the carburetor to the intake manifold of an internal-combustion engine is accomplished with a minimum amount of excess fuel.

It is a further object of the present invention to provide a novel fuel separating device which is characterized by simplicity of structure and economy of manufacture.

In connection with the preceding object, the fuel separating device of the present invention contains no moving parts and is constructed so that it may be easily assembled in the form of an accessory for application to existing internal-combustion engines and, particularly, to engines in automotive vehicles.

Further objects, advantages, and applications of the present invention will become apparent to those skilled in the art of fuel-air mixing systems when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein:

FIG. 1 is a fragmentary perspective view of in vehicle having an internal-combustion engine incorporating the fuel separating device of the present invention;

FIG. 2 is a longitudinal section of the fuel separating device shown in FIG. 1; and FIG. 3 is fragmentary cross-sectional view of the fuel separating device taken along Line 3—3 of FIG. 2.

DESCRIPTION OF THE PREFERRED EMBODIMENT

Referring now to the drawing and, in particular, to FIG. 1 wherein there is illustrated one example of the present invention in the form of a fuel separating device 10 shown to be interposed between a carburetor 12 and an intake manifold 14 of an internal-combustion engine 16. In the present example the internal-combustion engine 16 is that of an automotive vehicle 18; however, it should be appreciated that the present invention has application to other internal-combustion engines, and the same is disclosed herein only for purposes of illustration but is not meant to be a limitation of the invention. It should also be understood that, while the preferred embodiment of the present invention is described in connection with the gasoline engine 16, it will be appreciated that it is applicable for use in other types of engines for the purpose of removing excess fuel in the manner to be described hereinafter.

As can best be seen in FIGS. 2 and 3, the fuel separating device 10 comprises a cylindrically shaped housing 20 enclosed at its upper end by a cover 24 and enclosed at its lower end by a mounting plate 26. The housing 20 consists of two cylindrical wall portions 28 and 30 which are, respectively, connected to the cover 24 and the mounting plate 26 by any suitable means, such as by welding, indicated by the numeral 32. The connection must be such as to provide a fluid-tight relationship. The adjacent edges of the cylindrical housing wall portions 28 and 30 are, in turn, connected by welding or the like to a fuel barrier plate 34 which is disposed between the cover 24 and the mounting plate 26 to define an upper fuel-air chamber 36 and a lower fuel-air chamber 38.

The mounting plate 26 and the barrier plate 34 are maintained at a predetermined distance by means of sleeve members 40 which are welded to the bottom side of the barrier plate 34 and the top surface of the mounting plate 26, such that the interior bores 42 of the sleeve members 40 are in axial alignment with bores 44 and 46 respectively, extending through the fuel-air barrier plate 34 and the mounting plate 26 for a purpose to be described hereinafter. The barrier plate 34 and the cover 24 are separated a predetermined distance by means of sleeve members 48 which have their opposite ends respectively welded to the upper surface of the fuel-air barrier plate 34 and the lower surface of the cover 24, such that the interior bores 50 of the sleeve members 48 are in axial alignment with the axial bores 44 in the barrier plate 34 and through bores 52 in the cover 24. As can best be seen in FIG. 2, the axial alignment of the aforementioned bores in the sleeve members, plates, and cover provides a pair of longitudinal bores through which fastening bolts 54 may extend for a threaded engagement with threaded inserts 56 mounted within the face of the intake manifold 14 so as to secure the fuel separator device 10 to the manifold 14 in such a manner that the lower chamber 38 of the fuel separator device 10 communicates with the inlet 55 of the engine manifold 14 through the exhaust port 58 extending through the mounting plate 26.

The upper cylindrical wall portion 28 of the fuel separator device 10 has an inlet port 59 which is connected to an angled pipe 60 which, as can best be seen in FIG. 1, terminates in a mounting flange mounting the conventional carburetor 12. The angled pipe 60 provides a dual function of communicating the fuel-air mixture from the carburetor 12 to the upper chamber 36 while, at the same time, permitting the carburetor 12 to be mounted within the engine compartment in such a manner that a conventional and standard air filter may be positioned on top of the carburetor, yet permitting the engine hood to be closed without interference from the carburetor, air filter, or the fuel separating device 10; thus, the device 10 may be attached to existing models without modification to the automobile compartment or may be employed in future designs without concern for the amount of space available within the engine compartment.

As can best be seen in FIGS. 2 and 3, the fuel-air barrier plate 34 is provided with a plurality of through bores 62 into which are inserted a plurality of tubular members 63. Suitable means are provided at the juncture of the upper surface 64 of the barrier plate 34 and the outer surface of each of the plurality of tubular members 63 to insure that there is a fluid-tight seal between the two, for a purpose to be described hereinafter. It can thus be seen that a flow passage for the fuel-air mixture is provided from the carburetor 12 through the angled pipe 60 and inlet port 59 into the upper chamber 36 of the fuel separator housing 20. The vaporized fuel-air mixture is then drawn into the interior bores 66 of the tubular members 63 and passed through the barrier plate 34 into the lower chamber 38 wherein the suction created by the reciprocating pistons of the internal-combustion engine draws the air-fuel mixture through the outlet port 58 and into the inlet 56 of the intake manifold 14 wherein the fuel-air mixture is burned in a conventional manner to power the internal-combustion engine 16. At the same time droplets of the fuel that are carried into the upper chamber 36 with the fuel-air mixture, fall to the surface 64 of the barrier plate 34. The drops of fuel, as indicated by the numeral 68, are collected in an annular groove 70 which, in turn, commmunicates with an axial bore 72 that extends through the barrier plate 34 and externally of the fuel separating device 10 for connection to a suitable conduit 78. Conduit 78 is connected via a one-way check valve 80 and a pump 82 to the vehicle fuel supply tank 84 such that the excess fuel that collects in the groove 70 may be drawn from the fuel separating device 10 by means of the pump 82 and returned to the vehicle fuel supply tank 84. The check valve 80 is provided in the event the engine vacuum pressure exceeds the fuel pump's output such that there will not be a back flow of fuel from the vehicle tank 84 to the fuel separator device 10.

In actual tests a six-cylinder, 1973, Ford F- 100truck having a 240 cubic inch internal-combustion engine with a standard transmission was modified to receive the fuel separator device 10 of the present invention. Prior to the incorporation of the fuel separator device 10, the aforementioned engine experienced between 12 and 16 miles to the gallon of fuel. Without further modification to the engine during a 65-mile test run in both city and highway driving, approximately 135ounces of fluid were returned to the fuel tank through the pump 82. This resulted in an overall fuel efficiency of approximately 30 miles to the gallon. It was noted that during the test there was no loss of engine power or top speed as a result of the incorporation of the fuel separator device 10; and it should be further noted that because of the fuel separator device 10 and the removal of raw gas from the fuel-air mixture, it is virtually impossible to flood the engine because raw gas cannot get directly into the engine.

It should also be noted that the present invention may be embodied in other specific forms without departing from the spirit or essential characteristics of the invention. An example of the modification of the fuel separator device 10 may consist of eliminating the angled pipe 60 and mounting the carburetor 12 directly to the top of the cover 24 with an aperture being provided in the center of the cover 24 so that direct communication may be had from the carburetor 12 to the upper chamber 36. In this situation a horizontal baffle would have to be provided to permit direct communication from the carburetor to the open ends of the plurality of tubular members 63.

The present invention is therefore to be considered in all respects as illustrative and not restrictive, the scope of the invention being indicated by the appended claims rather than by the foregoing description, and all claims which come within the meaning and range of equivalency of the claims are therefore intended to be embraced therein.

What is claimed is as follows:

1. A fuel separating device adapted to be connected between a carburetor and an intake manifold of an internal-combusion engine for removing excess fuel from the fuel-air mixture provided by said carburetor, said device comprising:

a housing having upper and lower chambers;

plate means separating said chambers;

an inlet port for communicating with said upper chamber and adapted to be connected to the outlet of said carburetor for communicating the fuel-air mixture from said carburetor to said upper chamber;

an outlet port communicating with said lower chamber and adapted to be connected to the inlet of said manifold for communicating said fuel-air mixture from said lower chamber to said intake manifold;

a plurality of upright tubular members extending through said plate means, one end of each of said tubular members terminating in the upper regions of said upper chamber, the other ends of said tubular members opening into said lower chamber to provide a fluid flow passage for directing said mixture from said carburetor to said manifold while excess fuel droplets carried by said air-fuel mixture drop to the bottom of said upper chamber; and means associated with said upper chamber for drawing off said excess fuel which accumulates therein.

2. The fuel separating device defined in claim 1 further comprising an annular groove formed in the upper surface of said plate means within which said gas droplets accumulate; and a through bore extending through said plate for communicating with said annular groove for drawing said excess gas from said fuel separating device.

3. The fuel separating device defined in claim 1 wherein said means associated with said upper chamber draws off said excess gas which accumulates therein and communicates said excess gas to the fuel supply for said internal-combustion engine.

4. The fuel separating device defined in claim 2 wherein said conduit is connected to the fuel supply for said internal-combustion engine such that said excess gas is returned to said fuel supply.

5. The fuel separating device defined in claim 4 further comprising a pump disposed in said conduit for forcibly drawing said excess gas from within said fuel separating device and returning said excess fuel to said fuel supply.

6. The fuel separating device defined in claim 5 further comprising a one-way check valve disposed in said conduit between said fuel separating device and said pump to prevent the back flow of said fuel from said pump to said fuel separating device.

7. The fuel separating device defined in claim 1 wherein said inlet port is disposed in a side wall of said housing.

* * * * *